US006321554B1

(12) United States Patent
Rigoni

(10) Patent No.: US 6,321,554 B1
(45) Date of Patent: Nov. 27, 2001

(54) FLUSH-MOUNT ENCLOSURE, PARTICULARLY FOR MAKING PROVISIONS FOR AIR-CONDITIONING SYSTEMS

(75) Inventor: Giorgio Rigoni, Conegliano (IT)

(73) Assignee: Tecnosystemi S.r.l., San Vendemiano (IT)

( * ) Notice: Subject to any disclaimer, the term of this patent is extended or adjusted under 35 U.S.C. 154(b) by 0 days.

(21) Appl. No.: 09/492,747

(22) Filed: Jan. 27, 2000

(30) Foreign Application Priority Data

Jan. 29, 1999 (IT) ..... TV99A0012

(51) Int. Cl.[7] ..... F25D 21/00

(52) U.S. Cl. ..... 62/272; 62/259.1; 62/285; 62/286; 62/288

(58) Field of Search ..... 62/259.1, 285, 62/272, 286, 288

(56) References Cited

U.S. PATENT DOCUMENTS 4,549,405 * 10/1985 Anderson et al. ..... 62/239
4,843,835 * 7/1989 Goetz et al. ..... 62/285
4,907,420 * 3/1990 Mahanay et al. ..... 62/291
4,941,901 * 7/1990 Ramakrishnan et al. ..... 62/262
5,024,065 * 6/1991 Barrett ..... 62/285
5,787,721 * 8/1998 Fromm et al. ..... 62/285
6,105,383 * 8/2000 Reimann et al. ..... 62/285
6,112,536 * 9/2000 Hansen ..... 62/285

* cited by examiner

*Primary Examiner*—William Doerrler
*Assistant Examiner*—Mark Shulman
(74) *Attorney, Agent, or Firm*—Guido Modiano; Albert Josif; Daniel O'Byrne

(57) ABSTRACT

A flush-mount enclosure, particularly for making provisions for air-conditioning systems, comprising a box-like containment body for refrigeration tubing and a power supply cable, a condensation collector being associable, so that it can be removed and turned through 180°, with said box-like body in a downward region, said collector having at least an outlet arranged at a lateral end thereof.

16 Claims, 3 Drawing Sheets

FLUSH-MOUNT ENCLOSURE, PARTICULARLY FOR MAKING PROVISIONS FOR AIR-CONDITIONING SYSTEMS

BACKGROUND OF THE INVENTION

The present invention relates to a flush-mount enclosure, particularly for making provisions for air-conditioning systems.

Currently, the provision of an air-conditioning system entails the need for a connection between an external motorized condensing unit and an internal unit by means of two thermally insulated tubes which are adapted to transfer the refrigeration fluid between the two units.

The internal unit must further be supplied with power, usually by means of an electrical cable, and has a pipe for discharging the condensed moisture.

In order to facilitate the installer in positioning the internal unit, it is known to provide enclosures for the refrigeration tubing and for the electrical cable; such enclosures are essentially shaped like parallelepipeds and are recessed in the wall at the region where the internal unit is placed.

Such enclosures have standardized dimensions in order to allow to place thereat suitable templates for mounting the internal unit.

One problem that arises is the discharge of condensation: usually, in the case of provisions for the air-conditioning system, it is known to build into the wall a pipe for discharging the condensed water; the condensation outlet of the internal unit must subsequently be connected to such pipe.

In the internal unit, the condensation outlet may be located on a side that does not correspond to the one where the discharge pipe has been provided in the wall, thus forcing the installer to provide the connection by means of a hose, whose path is necessarily approximately horizontal, in order to reach the other end; therefore condensation may stagnate and bad odors may form.

SUMMARY OF THE INVENTION

The aim of the present invention is to solve the above-mentioned problems, eliminating the drawbacks of the cited prior art, by providing a flush-mount enclosure, particularly for making provisions for air-conditioning systems, which allows optimum placement not only of, for example, the refrigeration tubing and of the power supply cable for an internal unit, but also of the discharge or condensation pipe of the internal unit, at the same time allowing optimum drainage of the condensation.

Within the scope of this aim, an important object of the present invention is to provide an enclosure in which optimum condensation draining can be achieved regardless of whether the condensation outlet connected to the internal unit is located at the right end or at the left end of the internal unit.

Another important object of the present invention is to provide an enclosure which avoids the formation of stagnating condensed water.

Another object of the present invention is to provide an enclosure which is structurally simple and has an optimum connection to a condensation outlet without requiring subsequent interventions of the installer when the internal unit is fitted.

This aim, these objects and others which will become apparent hereinafter are achieved by a flush-mount enclosure, particularly for making provisions for air-conditioning systems, which comprises a box-like containment body for refrigeration tubing and a power supply cable, characterized in that a condensation collector is associable, so that it can be removed and turned through 180°, with said box-like body in a downward region, said collector having at least an outlet arranged at a lateral end thereof.

BRIEF DESCRIPTION OF THE DRAWINGS

Further characteristics and advantages of the present invention will become apparent from the following detailed description of a particular embodiment thereof, illustrated only by way of non-limitative example in the accompanying drawings, wherein.

DESCRIPTION OF THE PREFERRED EMBODIMENTS

Figure 1:
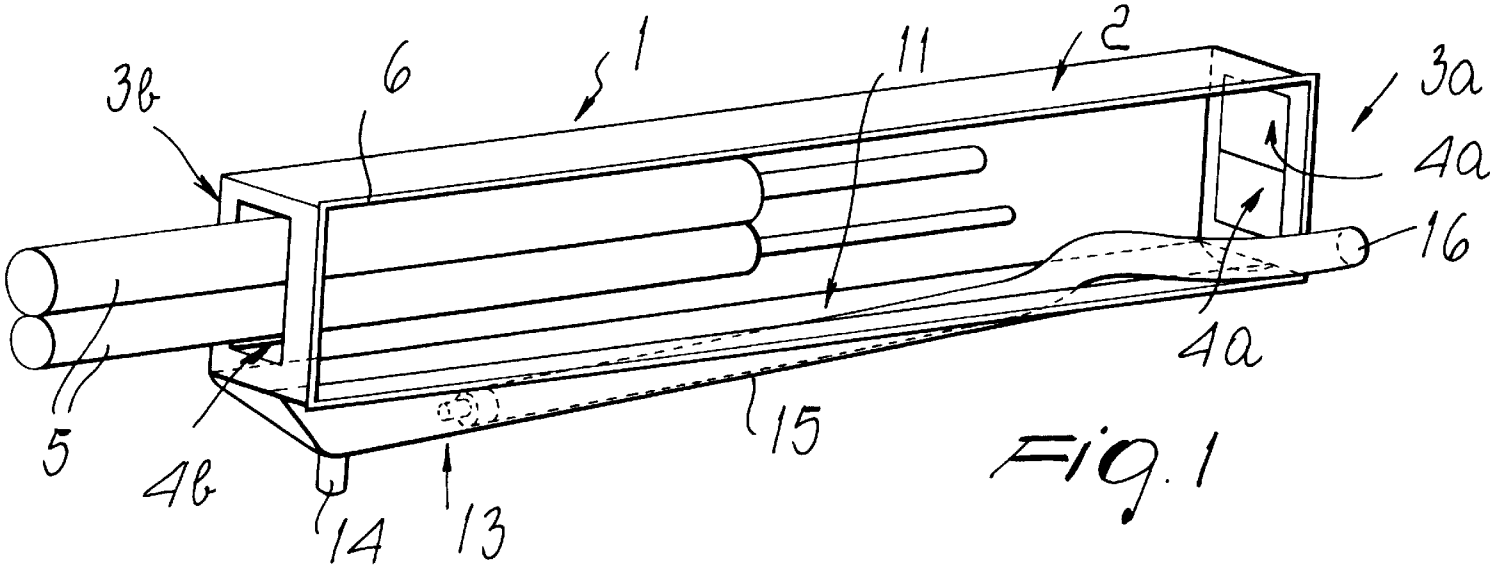
FIG. 1 is a top perspective view of the enclosure according to the present invention.
Figure 2:
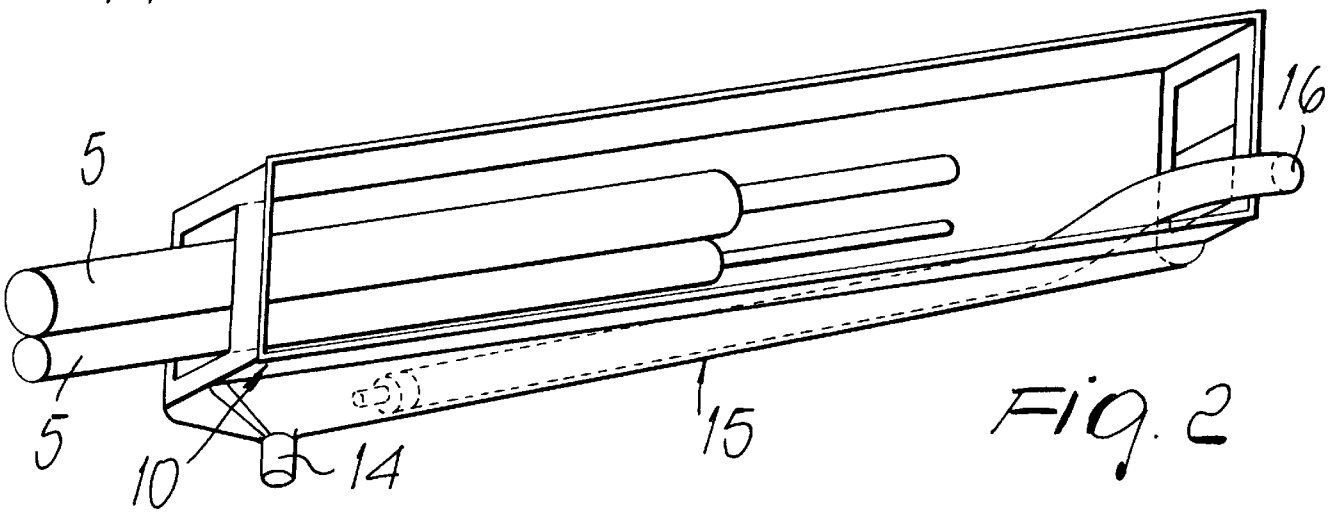
FIG. 2 is a bottom perspective view of the enclosure.
Figure 3:
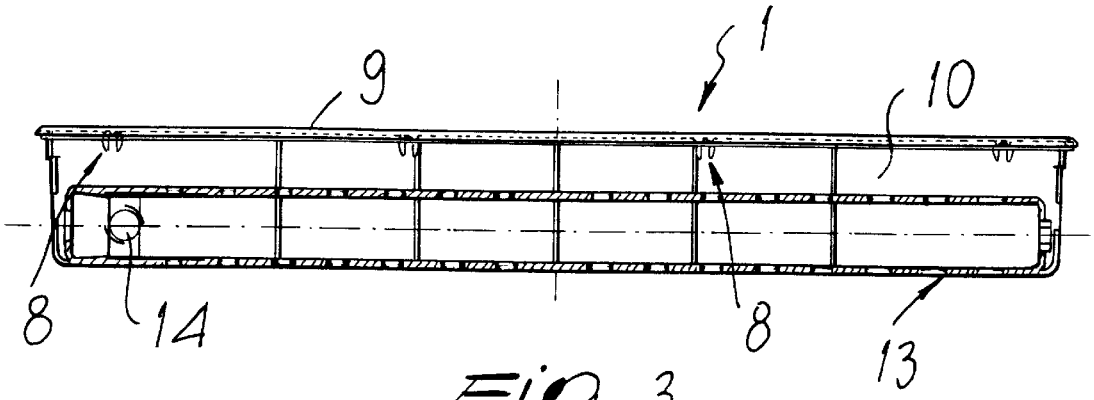
FIG. 3 is a bottom view of the enclosure.
Figure 4:
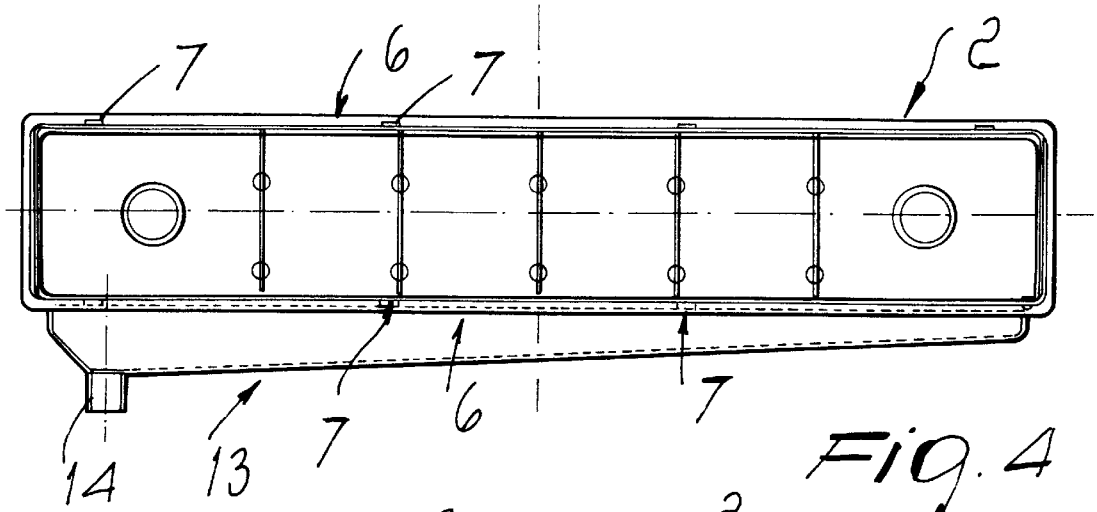
FIG. 4 is a front view of the enclosure, with the closure panel omitted.
Figure 5:
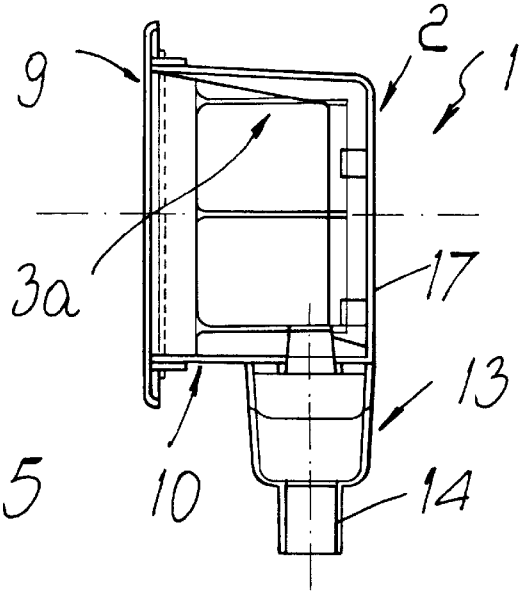
FIG. 5 is a sectional side view, taken along the line V—V of FIG. 4.
Figure 6:
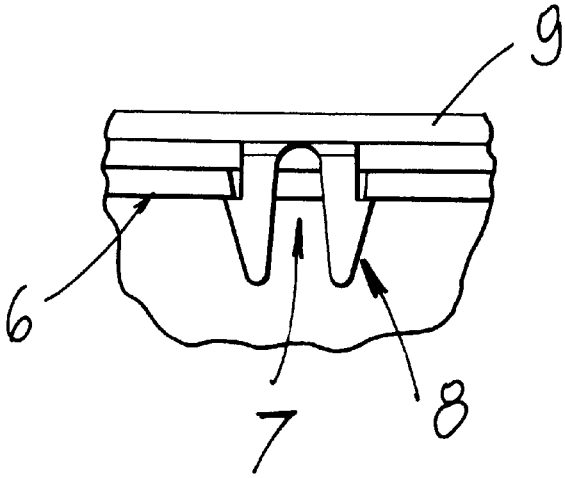
FIGS. 6, 7 and 8 are detail views of the connection between the closure panel and the box-like body and between the collector and the box-like body.
Figure 7:
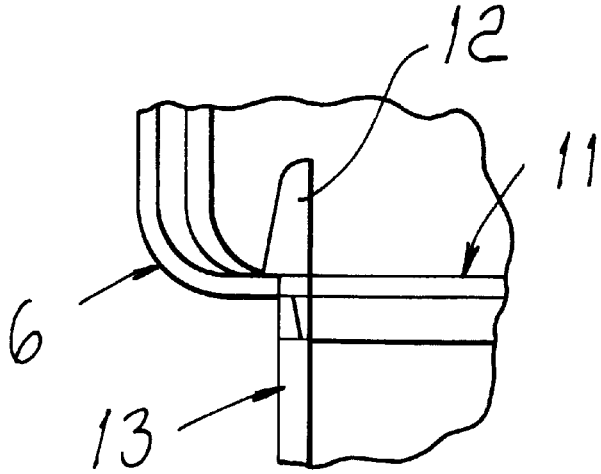
Figure 8:
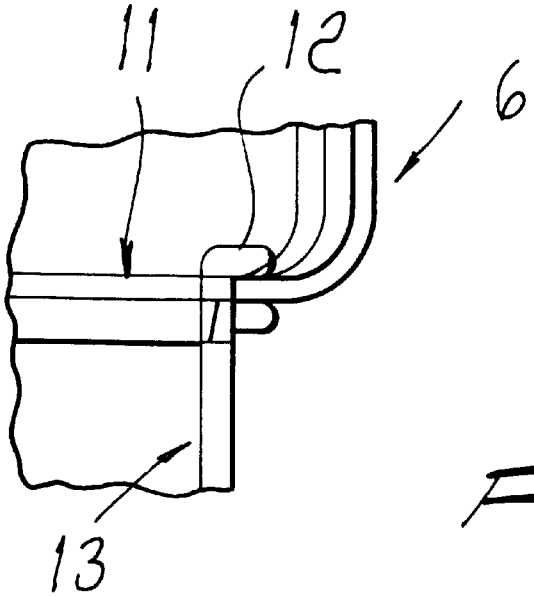

With reference to the above-cited figures, 1 designates a flush-mount enclosure, which is used particularly for making provisions for air-conditioning systems.

The enclosure is constituted by a box-like flush-mount body 2, preferably shaped like a parallelepiped, which has, at its lateral surfaces 3*a* and 3*b*, suitable openings 4*a* and 4*b* for lateral insertion of suitable refrigeration tubing 5 and of a possible power supply cable for the internal unit of an air-conditioning system, which is not shown.

The box-like body 2 has a front opening and, at a perimetric edge 6, suitable first seats 7 for temporarily accommodating first elastically compressible tabs 8 which protrude from an adapted closure panel 9, which can thus be inserted by pressing and can be removed accordingly.

The box-like body 2 has, at its lower surface 10, a longitudinal opening 11 at which suitable second seats are formed perimetrically for the removable engagement of second tabs 12 which protrude perimetrically at the upper region of a condensation collector 13.

The collector 13, which can be arranged below the body 2 by providing an appropriate recess formed for example in the wall or masonry, has a length which is approximately equal to the length of the box-like body 2 and is substantially funnel-shaped, with at least an outlet 14 arranged proximate to a lateral end of the collector.

The collector 13 therefore defines an inclined surface 15 which blends, at a first end, approximately with the plane of arrangement of the lower surface 10 of the box-like body 2 and blends, at a second end, approximately with the inlet plane of the outlet 14.

A suitable condensation hose 16, for example a flexible one which is associated with, and originates from, the internal unit, can then be arranged on the inclined surface 15 without needing a connection to the outlet 14, which during the flush-mounting of the box-like body 2 can instead be directly connected to discharge pipes which are in turn built into the masonry, again by means of a flexible hose.

The use of the enclosure in fact allows to recess the box-like body 2 in the masonry, placing the tubing 5 and the power supply cable inside it and the collector below it.

When the installer positions the template and the internal unit, he merely has to place the condensation hose 16 at the inclined surface 15 of the collector 13.

In this manner, owing to the inclination of the surface 15, optimum discharge of condensation occurs at the outlet 14, which is already connected to suitable piping.

Advantageously, the collector 13 is arranged below the box-like body 2 and adjacent to a rear surface 17 thereof, so as to leave enough space, in the front part, for locking the template of air-conditioning units by fixing with wall plugs.

If the air-conditioning units have a condensation hose 16 located at the other end, it is sufficient for the installer to disconnect the collector 13 from the box-like body 2 and reconnect it to the box-like body 2 after turning it through 180°.

It has thus been observed that the invention has achieved the intended aim and objects, an enclosure having been provided which allows optimum discharge of condensed water without requiring the installer to provide particular connections or slopes to be given for example to the condensation hose of the internal unit.

The enclosure can also be adapted rapidly and simply according to the position of the condensation hose and of the various internal units.

The invention is of course susceptible of numerous modifications and variations, all of which are within the scope of the same inventive concept.

The materials and the dimensions that constitute the individual components of the invention may of course be the most appropriate according to specific requirements.

The disclosures in Italian Patent Application No. TV99A000012 from which this application claims priority are incorporated herein by reference.

What is claimed is:

1. A flush-mount enclosure, particularly for making provisions for air-conditioning systems, comprising a box-like containment body adapted to accommodate refrigeration tubing and a power supply cable, wherein a condensation collector is associable, so that it can be removed and turned through 180°, with said box-like body in a downward region, said collector having at least an outlet arranged at a lateral end thereof, said box-like boy with said condensation collector connected thereto being insertable in a wall.

2. The enclosure according to claim 1, wherein said box-like body has, at a lower surface thereof, a longitudinal opening at which seats are formed perimetrically for a removable engagement of tabs which protrude perimetrically in an upper region of the condensation collector.

3. The enclosure according to claim 1, wherein said collector is arranged under said body by providing a recess in a wall or masonry.

4. The enclosure according to claim 1, wherein said collector has a length which is approximately equal to the length of said box-like body and is funnel-shaped.

5. The enclosure according to claim 2, wherein said collector has an inclined surface which blends, at a first end, approximately with a plane of arrangement of the lower surface of said box-like body and blends, at a second end, approximately with an inlet plane of said at least one outlet.

6. The enclosure according to claim 5, wherein a condensation hose is arranged on said inclined surface.

7. The enclosure according to claim 3, wherein said at least one outlet is connected to condensation discharge pipes which are built into said wall.

8. The enclosure according to claim 1, wherein said collector is arranged below said box-like body adjacent to a rear surface thereof.

9. A flush-mount enclosure, particularly for making provisions for air-conditioning systems, comprising a box-like containment body for refrigeration tubing and a power supply cable, wherein a condensation collector is associable, so that it can be removed and turned through 180°, with said box-like body in a downward region, said collector having at least an outlet arranged at a lateral end thereof, said collector being arranged under said body by providing a recess in a wall or masonry.

10. The enclosure according to claim 9, wherein said box-like body has, at a lower surface thereof, a longitudinal opening at which seats are formed perimetrically for a removable engagement of tabs which protrude perimetrically in an upper region of the condensation collector.

11. The enclosure according to claim 9, wherein said collector is arranged under said body by providing a recess in a wall or masonry.

12. The enclosure according to claim 9, wherein said collector has a length which is approximately equal to the length of said box-like body and is funnel-shaped.

13. The enclosure according to claim 10, wherein said collector has an inclined surface which blends, at a first end, approximately with a plane of arrangement of the lower surface of said box-like body and blends, at a second end, approximately with an inlet plane of said at least one outlet.

14. The enclosure according to claim 13, wherein a condensation hose is arranged on said inclined surface.

15. The enclosure according to claim 9, wherein said at least one outlet is connected to condensation discharge pipes which are built into said wall.

16. The enclosure according to claim 9, wherein said collector is arranged below said box-like body adjacent to a rear surface thereof.

* * * * *

UNITED STATES PATENT AND TRADEMARK OFFICE

CERTIFICATE OF CORRECTION

PATENT NO. : 6,321,554 B1
DATED : November 27, 2001
INVENTOR(S) : Giorgio Rigoni It is certified that error appears in the above-identified patent and that said Letters Patent is hereby corrected as shown below:

Title page,
Item [30], Foreign Application Priorty Data, should read:
-- Jan. 28, 1999 (IT) ..... TV99A000012 --

Signed and Sealed this

Fourth Day of January, 2005

JON W. DUDAS
*Director of the United States Patent and Trademark Office*